US008628208B1

(12) United States Patent
Yang

(10) Patent No.: US 8,628,208 B1
(45) Date of Patent: Jan. 14, 2014

(54) FLICKERING CANDLE

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 13/802,784

(22) Filed: Mar. 14, 2013

(51) Int. Cl.
*F21L 19/00* (2006.01)

(52) U.S. Cl.
USPC ..... 362/161; 362/392; 362/447; 362/810

(58) Field of Classification Search
USPC ..... 362/606, 161, 392, 447, 810
See application file for complete search history.

(56) References Cited

U.S. PATENT DOCUMENTS 6,550,936 B2 * 4/2003 Foley ..... 362/268
7,934,845 B2 * 5/2011 Yang ..... 362/101
7,997,772 B2 * 8/2011 Avtzon et al. ..... 362/392
2013/0016495 A1 * 1/2013 Lee ..... 362/86

* cited by examiner

*Primary Examiner* — Evan Dzierzynski
(74) *Attorney, Agent, or Firm* — Leong C. Lei

(57) ABSTRACT

A flickering candle is provided, mainly including: a candle main body, a base and a pattern unit. The candle main body is a hollow light-transmittable shell, with an outer surface, an inner surface, a top and a bottom, both connecting the outer surface and the inner surface. The base is fixedly engaged to the bottom of the candle main body, and disposed with at least a light-emitting element. The pattern unit includes a light-transmittable first patter plate, overlappingly disposed on the inner surface of the candle main body. The first pattern plate has a predefined pattern and a light-guiding part contacting the light-emitting element. As such, the light-emitting element at the base can disperse the light source through the light-guiding part onto the first pattern plate so that the predefined pattern becomes more spectacular to enhance the esthetics.

7 Claims, 9 Drawing Sheets

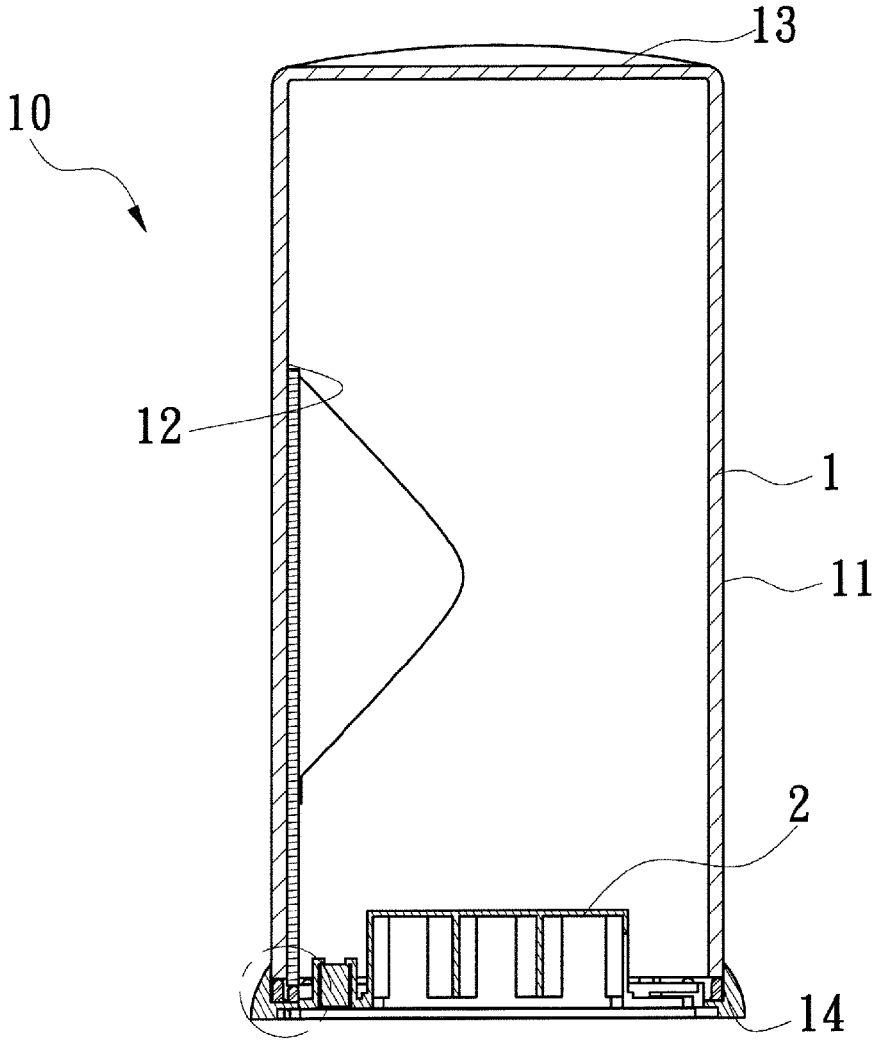
FIG.3
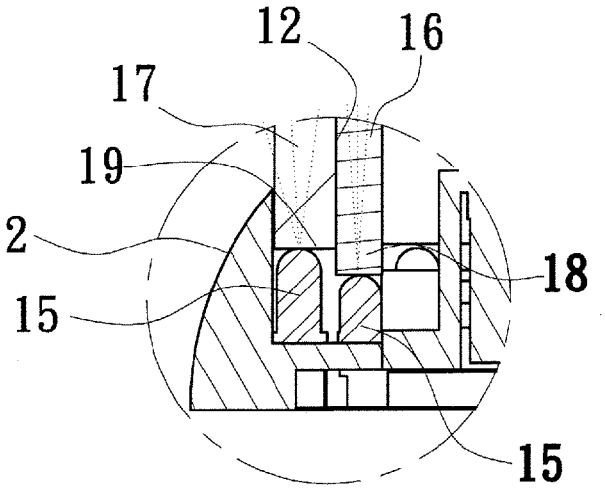

FLICKERING CANDLE

TECHNICAL FIELD OF THE INVENTION

The present invention generally relates to flickering candle, and more particularly to an electronic candle designed for visual esthetic display in an ambient.

DESCRIPTION OF THE PRIOR ART

As the concern of environmental protection becomes ubiquitous, the use of conventional candle with burning flame is brought into question. Instead, a reusable faux candle becomes popular. The variety of electronic candles available often provides only luminance function but lack of esthetic and fun results to enrich the ambient.

Thus, it is desirable to design an electronic candle with designed visual effects to enhance the esthetics and fun result in addition to static display of decoration and luminance.

SUMMARY OF THE INVENTION

The primary purpose of the present invention is to solve the problems associated with conventional electronic candle in lack of fun and ambience enrichment.

The present invention provides a flickering candle, mainly contains: a candle main body, being a hollow light-transmittable shell, having an outer surface, an inner surface, a top and a bottom, both connecting the outer surface and the inner surface; a base, fixedly engaged to the bottom of the candle main body, being disposed with at least a light-emitting element corresponding to the candle main body; and a pattern unit, including a light-transmittable first patter plate, overlappingly disposed on the inner surface of the candle main body, the first pattern plate having a predefined pattern and having a light-guiding part contacting the light-emitting element.

As such, the light-emitting element at the base can disperse the light source through the light-guiding part onto the first pattern plate so that the predefined pattern becomes more spectacular to enhance the esthetics.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 3 is a cross-sectional diagram according to the present invention.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
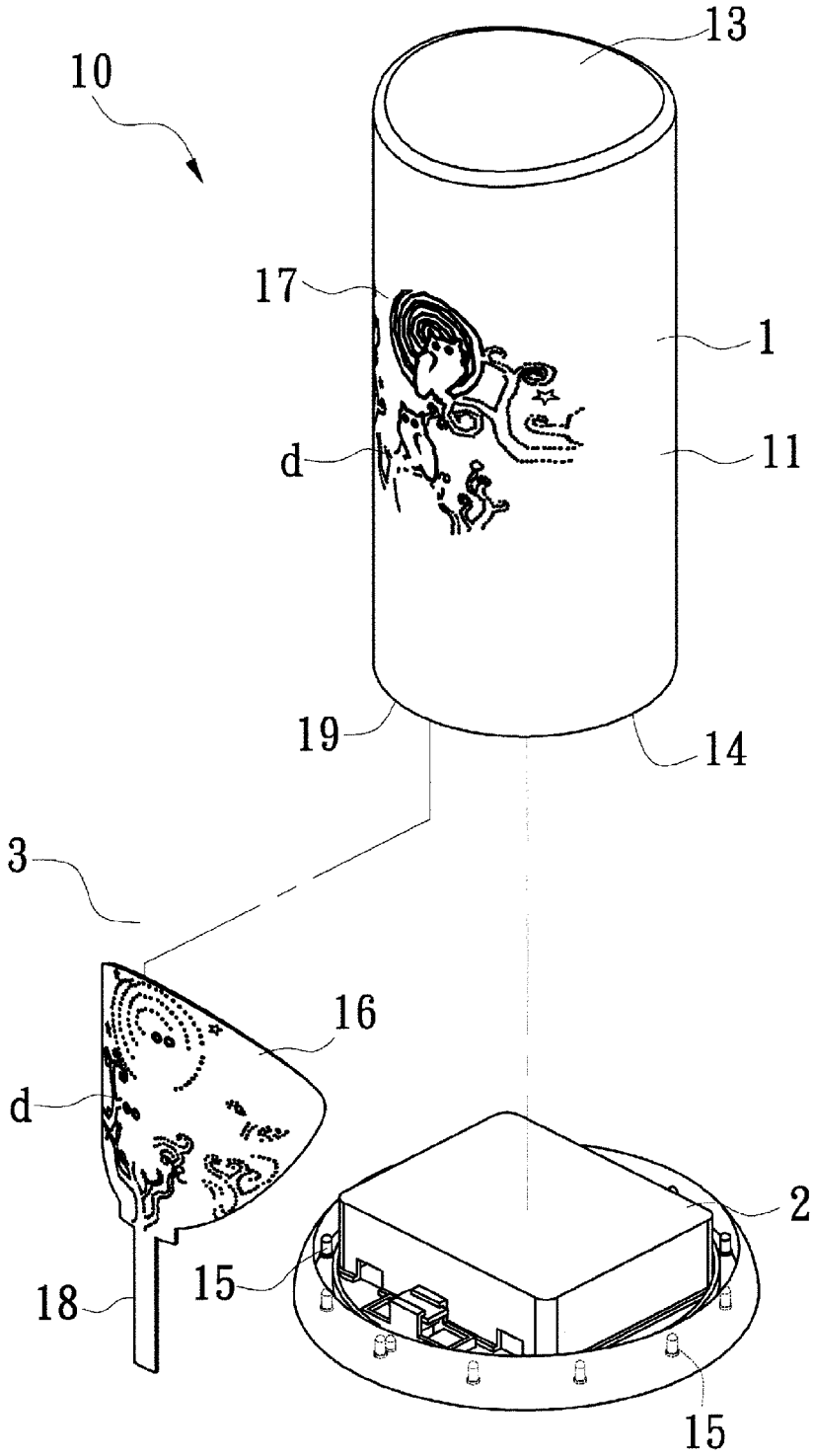
FIG. 1 is a dissected perspective diagram according to the present invention.
Figure 2:
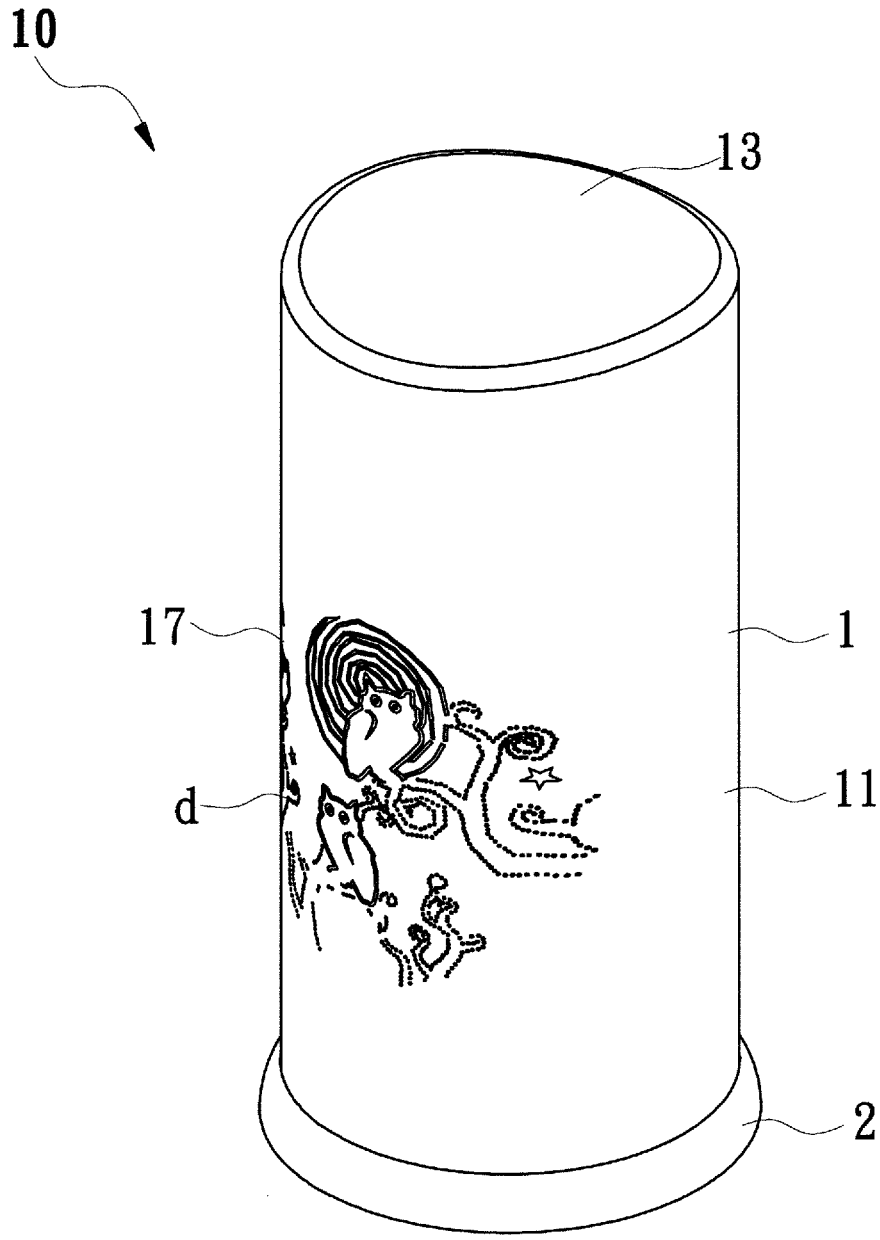
FIG. 2 is a perspective diagram according to the present invention.

As shown in FIGS. 1 to 3, FIGS. 1-3 show a dissected perspective diagram, a perspective diagram and a cross-sectional diagram of the present invention respectively. A flickering candle (10) mainly contains a candle main body (1), a base 92) and a pattern unit (3). The candle main body (1) is fixedly engaged to the top of the base (2), and the pattern unit (3) is overlappingly disposed inside the candle main body (1).

The candle main body (1) is a hollow light-transmittable shell, and has an outer surface (11), an inner surface (12), a top (13) and a bottom (14). Both the top (13) and the bottom (14) connect the outer surface (11) and the inner surface (12). The bottom (14) includes an opening. In the present embodiment, the candle main body is a cylinder, but is not limited to. Other shapes, such as, cubic, triangular pillar, can also be used.

The base (2) is fixedly engaged to the bottom (14) of the candle main body (1), and includes at least a light-emitting element (15) at location corresponding to the bottom (14) of the candle main body (1). In the present embodiment, the number of light-emitting elements (15) is plural and the light-emitting element (15) is a light-emitting diode (LED).

The pattern unit (3) contains a light-transmittable first pattern plate (16) and second pattern plate (17). The first pattern plate (16) is overlappingly disposed on the inner surface (12) of the candle main body (1). The first pattern plate (16) contains predefined pattern (d) and has a light-guiding part (18) contacting the light-emitting element (15). The second pattern plate (17) is overlapping on one side of the first pattern plate (16), and has a predefined pattern (d) corresponding to that of the first pattern plate (16). The second pattern plate (17) has a light-guiding part (19). The base (2) is disposed with light-emitting element (15) to correspondingly contact the light-guiding plate (19) of the second pattern plate (17). In the embodiment of FIG. 1, the second pattern plate (17) is formed by the surface of the candle main body (1) and the pattern (d) of the second pattern plate (17) is disposed on the outer surface (11). The light-guiding part (19) of the second pattern plate (17) is formed by the bottom (14) of the candle main body (1). In addition, the number of light-emitting element (15) can be single or plural and surrounding the bottom (14) of the candle main body (1). In this embodiment, a plurality of light-emitting elements (15) is included for description.

As such, the patterns (d) of the first pattern plate (16) and the second pattern plate (17) are painted by fluorescent paint and shined on by the light source of the light-emitting element (15) to display significant color. In the present embodiment, the pattern (d) includes dots and lines to outlines of buildings, scenes, people, and so on. The light-emitting element (15) corresponding to the first pattern plate (16) and the second pattern plate (17) take turns to turn on or flicker so that the patterns (d) on the first pattern plate (16) and the second pattern plate (17) can display a dynamic effect.

Figure 4:
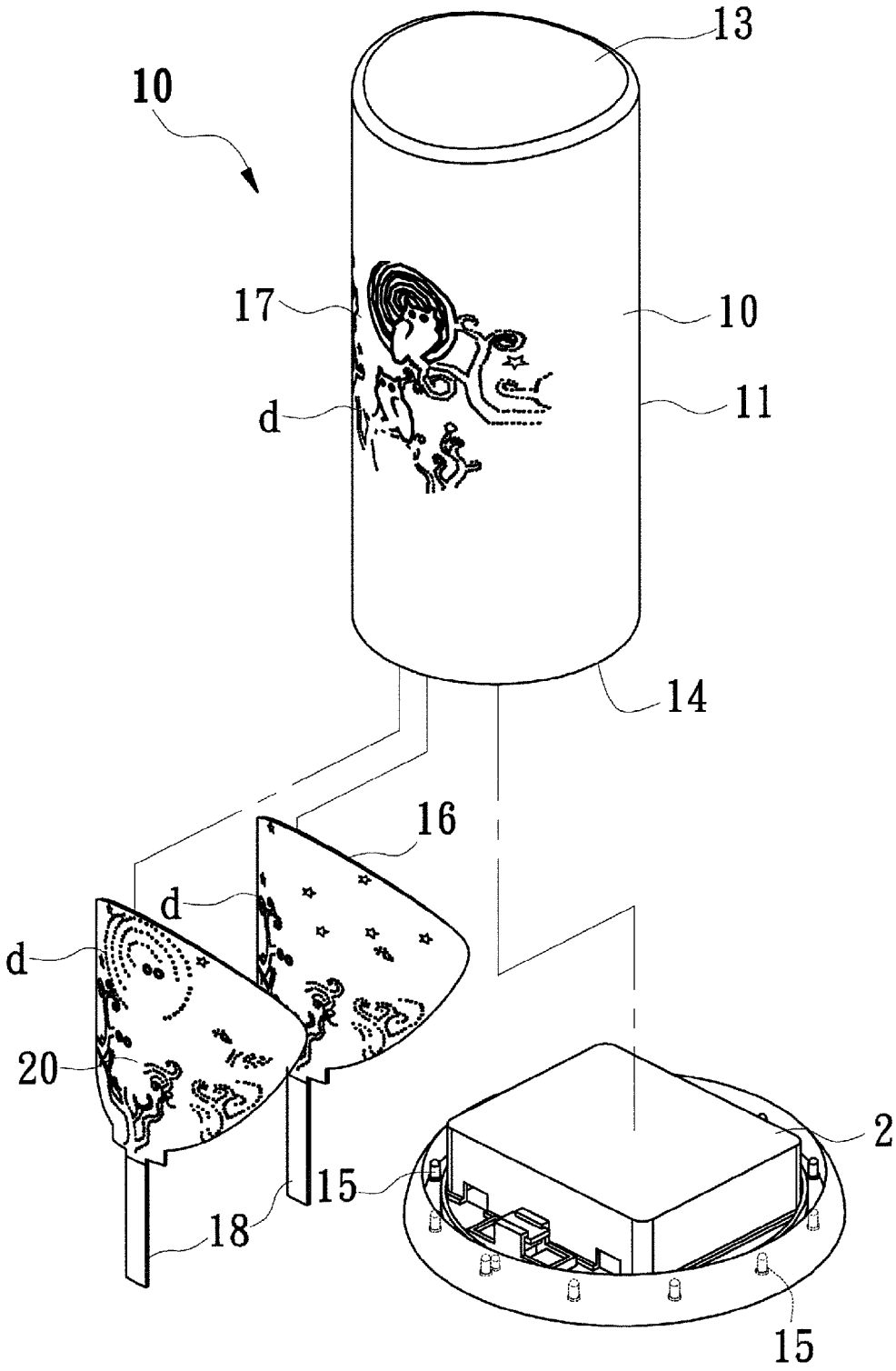
FIG. 4 is a perspective diagram showing a third pattern plate disposed according to the present invention.

Referring to FIG. 4, the pattern unit (3) further contains a third pattern plate (20) with predefined pattern (d) and overlapping disposed on one side of the second pattern plate (17). The effect of the third pattern plate (20) is to make the pattern (d) crisscross with other pattern plates to further enrich the fun. The structure is similar to the first pattern plate (16) and is not described here.

Figure 5:
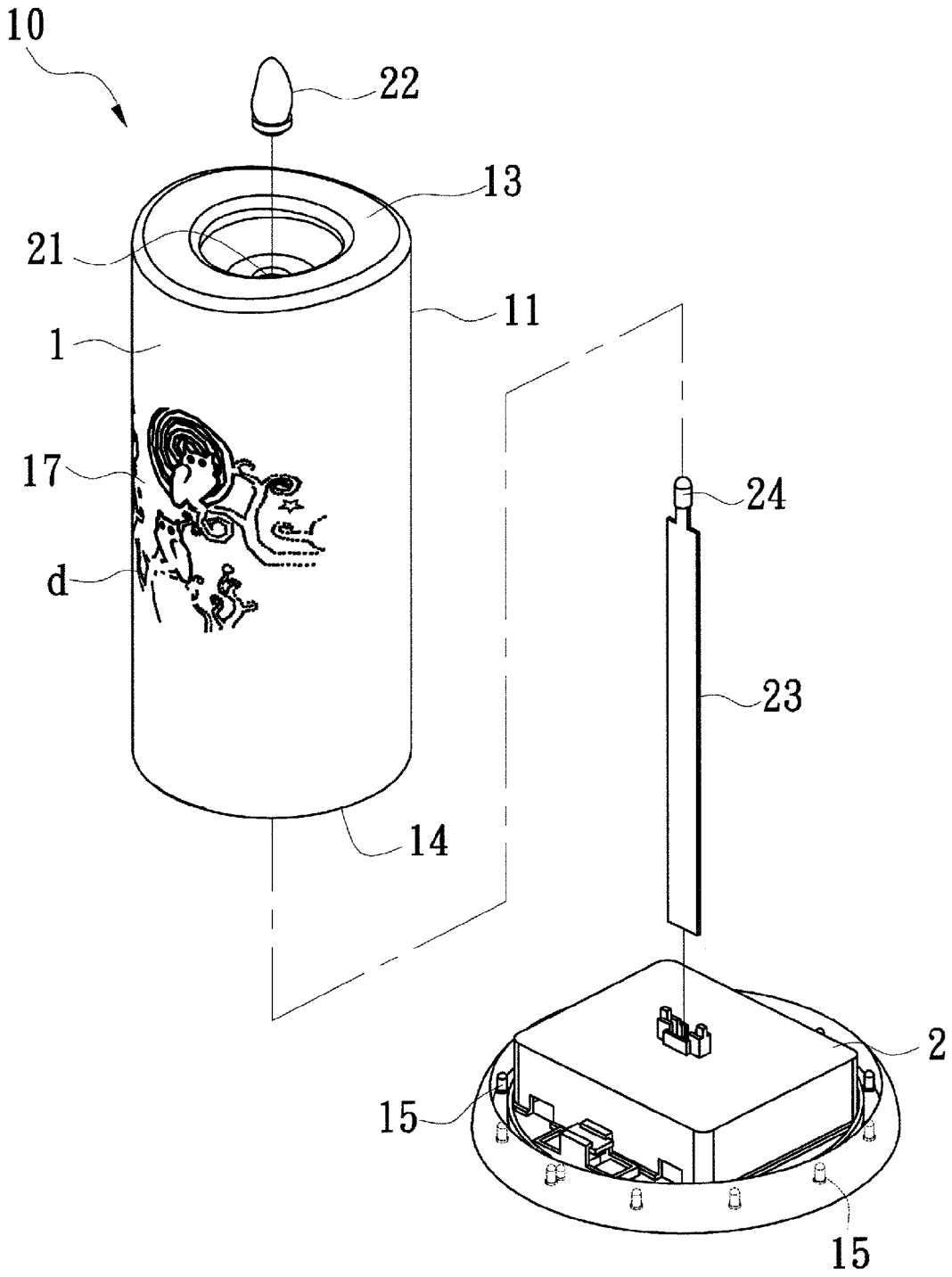
FIG. 5 is a dissected perspective diagram according to the second embodiment of the present invention.
Figure 6:
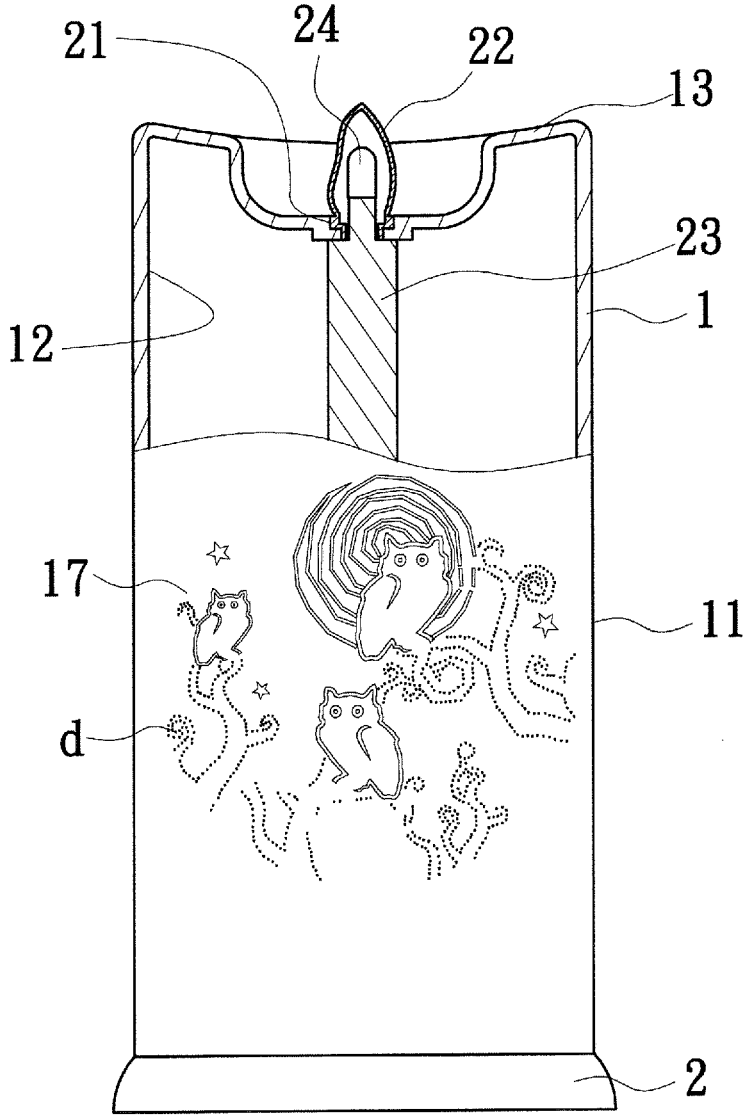
FIG. 6 is a partial cross-sectional diagram according to the second embodiment of the present invention.

Referring to FIGS. 5-6, FIGS. 5-6 show the dissected perspective diagram and partial cross-sectional diagram of the second embodiment respectively. The present embodiment differs from the first embodiment in that the top (13) of the candle main body (1) is disposed with a hole (21), and a shade (22) is disposed to cover on the hole (21). The shade (22) has a faux flame appearance. The base (2) further includes a circuit set (23). The circuit set (23) has a light-emitting element (24) disposed inside the shade (22). The light-emitting element (24) is controlled by the circuit set (23) to flicker so that the present invention display a faux flame effect of a conventional candle.

Figure 7:
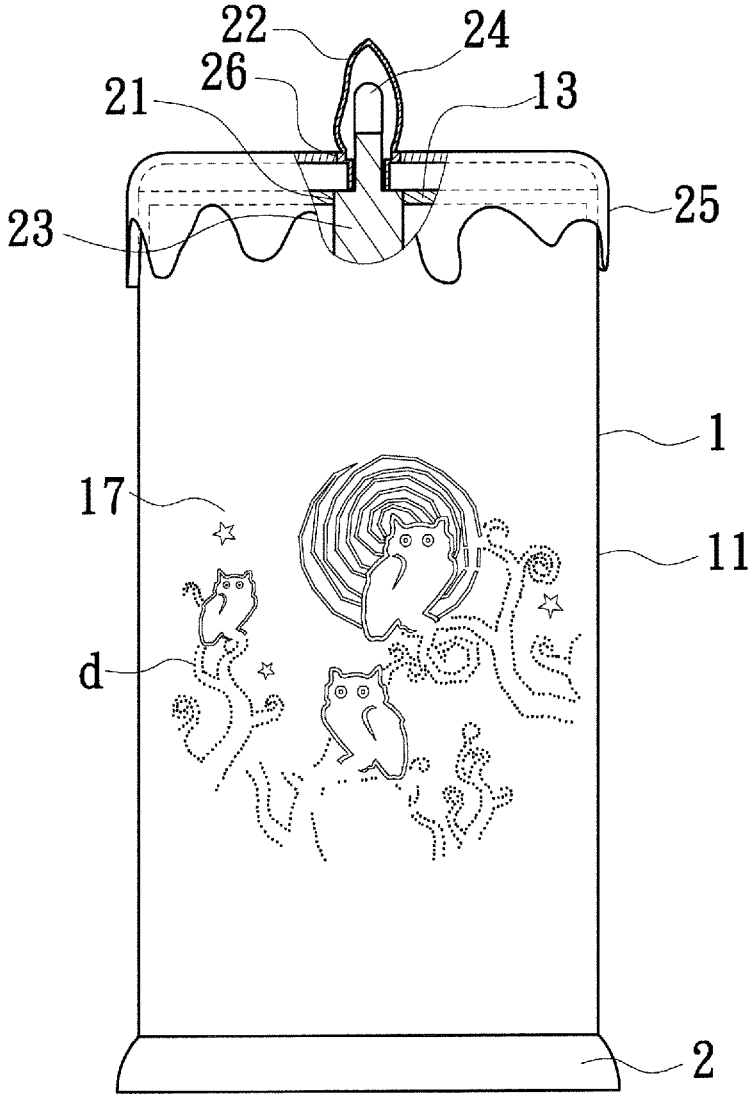
FIG. 7 is a perspective diagram showing an outer decorative body according to the second embodiment of the present invention.

In addition, as show in FIG. 7, the present invention further contains an outer decorative body (25) disposed on the top (13) of the candle main body (1). The outer decorative body (25) has a via (26) disposed corresponding to the shade (22). The shade (22) is exposed beyond the via (26). The outer decorative body (25) has a shape imitating a drop of wax oil so further imitate the appearance of an actual candle.

Figure 8:
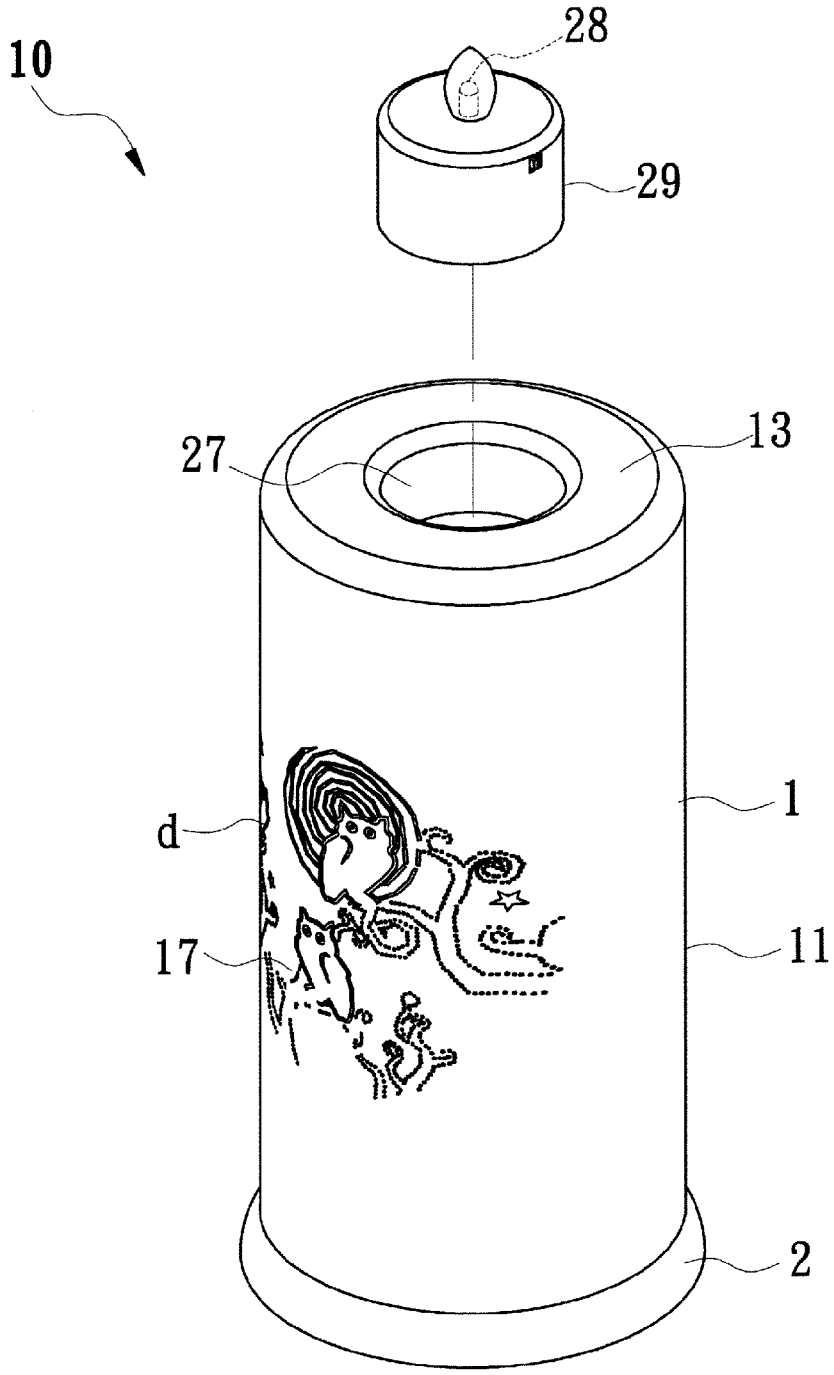
FIG. 8 is a dissected perspective diagram according to the third embodiment of the present invention.
Figure 9:
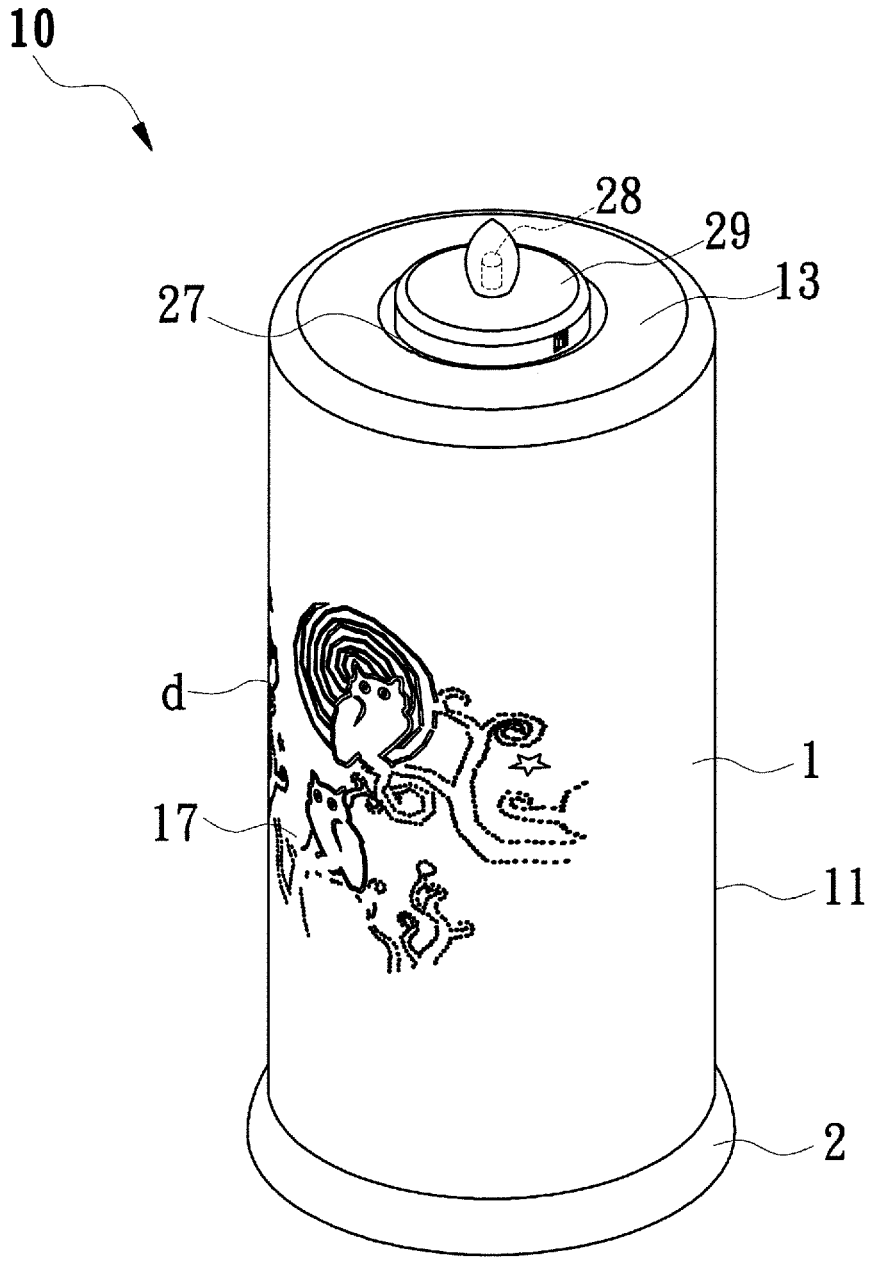
FIG. 9 is a perspective diagram according to the second embodiment of the present invention.

Refer to FIGS. 8-9 for the dissected diagram and perspective diagram of the third embodiment respectively. In the present embodiment, the top (13) of the candle main body (1) is disposed with a concave part (27). The concave part (27) is disposed with a light-emitting element (28). The light-emitting element (28) is powered by an electrical box (29). Because the embodiments of the light-emitting element (28) can be various, the description is omitted here.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A flickering candle, mainly comprising:

a candle main body, being a hollow light-transmittable shell, having an outer surface, an inner surface, a top and a bottom, both connecting the outer surface and the inner surface;

a base, fixedly engaged to the bottom of the candle main body, being disposed with at least a light-emitting element corresponding to the candle main body; and a pattern unit, comprising a light-transmittable first pattern plate, overlappingly disposed on the inner surface of the candle main body, the first pattern plate having a predefined pattern and having a light-guiding part contacting the light-emitting element.

2. The flickering candle according to claim 1, wherein the pattern unit further comprises a second pattern plate disposed overlappingly on one side of the first pattern plate, the second pattern plate has a predefined pattern corresponding to the first pattern plate, the second pattern plate has a light-guiding part, and the base has a light-emitting element corresponding to the light-guiding plate (19) of the second pattern plate.

3. The flickering candle according to claim 2, wherein the second pattern plate is formed by the outer surface of the candle main body.

4. The flickering candle according to claim 2, wherein the pattern unit further comprises a third pattern plate with predefined pattern and overlappingly disposed on one side of the second pattern plate.

5. The flickering candle according to claim 1, wherein the top of the candle main body is disposed with a hole, and a shade is disposed to cover on the hole; the base further comprises a circuit set, and the circuit set has a light-emitting element disposed inside the shade.

6. The flickering candle according to claim 5, further comprising an outer decorative body disposed on the top of the candle main body, the outer decorative body having a via corresponding to the shade.

7. The flickering candle according to claim 1, wherein the top of the candle main body is disposed with a concave part, and the concave part is disposed with a light-emitting element.

* * * * *